US010563951B1

(12) United States Patent
Sharps

(10) Patent No.: US 10,563,951 B1
(45) Date of Patent: Feb. 18, 2020

(54) HYBRID FIREARM RECEIVER WITH RAIL INTERFACE

(71) Applicant: Sharps Bros, LLC, Eugene, OR (US)

(72) Inventor: John Sharps, Eugene, OR (US)

(73) Assignee: SHARPS BROS. LLC, Eugene, OR (US)

( * ) Notice: Subject to any disclaimer, the term of this patent is extended or adjusted under 35 U.S.C. 154(b) by 0 days.

(21) Appl. No.: 16/377,147

(22) Filed: Apr. 5, 2019

(51) Int. Cl.
*F41C 23/06* (2006.01)
*F41C 23/04* (2006.01)

(52) U.S. Cl.
CPC ..... *F41C 23/06* (2013.01); *F41C 23/04* (2013.01)

(58) Field of Classification Search
CPC ..... F41C 23/04; F41C 23/06; F41C 23/08; F41C 23/20
USPC ..... 42/71.01, 75.03
See application file for complete search history.

(56) References Cited

U.S. PATENT DOCUMENTS 8,176,835 B1 * 5/2012 Cottle ..... F41A 19/11 42/69.01
2015/0176945 A1 * 6/2015 Simek ..... F41A 3/64 42/75.03
2016/0116250 A1 * 4/2016 Mather ..... F41C 23/04 42/73

FOREIGN PATENT DOCUMENTS

FR 2795169 A1 * 12/2000 ..... F41C 23/14

* cited by examiner

*Primary Examiner* — Stephen Johnson
(74) *Attorney, Agent, or Firm* — Lowe Graham Jones PLLC

(57) ABSTRACT

A hybrid firearm receiver includes a receiver body having a first end, a second end opposite the first end, a substantially planar bottom surface extending from the first end to the second end and transitioning to two upwardly extending opposing sidewalls, and a top end, the receiver body extending along a longitudinal axis from the first end to the second end. The first end is integrally formed with the receiver body and includes a first outer face and a rail interface that facilitates receiving a clamping mount of a gunstock between side edges of the rail interface and the first outer face. The rail interface has a plurality of flats disposed along a first plane that is transverse and non-perpendicular to the axis. The top end, the two opposing sidewall, and the first end form trough extending transverse to the axis.

14 Claims, 7 Drawing Sheets

HYBRID FIREARM RECEIVER WITH RAIL INTERFACE

FIELD OF THE INVENTION

This application relates generally to firearms, particularly including firearm receivers.

BACKGROUND OF THE INVENTION

Firearms such as rifles are popular amongst hunters, gun enthusiasts, sharpshooters, military and police personnel, and the like. For example, AK pattern rifles, including the AK-47, AKM, AK-74, and AK-100 rifles are widely appreciated for their substantial reliability, relatively low production costs, and ease of use. However, many firearms, including AK pattern rifles, possess both favorable and unfavorable features.

For example, AK pattern rifles are renowned for consistent performance under a variety of environmental conditions. Additionally, the firing mechanism of an AK pattern rifle is readily accessible within the rifle receiver, making it easy to repair and replace component parts of the firing mechanism. Yet, many users find the typical stock design of an AK pattern rifle to be undesirable. The typical AK-pattern stock is typically milled from a single piece of wood or plastic and assumes downward-sloping trapezoidal shape from the receiver toward the user. As a result, the stock is heavy, is not easily customized, and is therefore not ideal for users of varying builds and shooting styles. Moreover, the downward slope of the AK pattern stock results in a non-linear recoil path; that is, recoil action from firing is not transmitted in a straight line from the barrel back to the user's shoulder or other body part. This results in a recognizable feeling when the shooter absorbs and manages the recoil of an AK pattern rifle.

Other types of rifle stocks enjoy advantages over the AK pattern stock. For example, the stock of an AR-15 semiautomatic rifle is a lightweight, customizable, and ergonomically favorable stock that is amenable to use by users of varying builds and shooting styles. The AR-15 stock typically possesses a relatively low-profile, minimalist design, making the typical AR-15 stock lighter than the typical AK pattern stock. Additionally, the AR-15 stock attaches generally in line with the barrel, creating a straight recoil path from the barrel to the user's shoulder in the standard firing position. Moreover, the length of the AR-15 stock may be adjusted by pulling, thereby permitting a customized fit for a given user's body type and preferred shooting style. Thus, the stock may sit snugly against the lower receiver for use by a shooter with shorter arms or one who prefers tight control over the rifle, or may be extended away from the receiver for use by a shooter with longer arms or one who is otherwise more comfortable with a longer rifle configuration.

The differences between the typical AK pattern and AR-15 stocks are reflected in the connection mechanism between the stock and the receiver. For example, the AR-15 stock connects to the AR-15 lower receiver by means of a threaded, generally cylindrical buffer extension tube housed within a recess formed in the stock opposite the butt end. The buffer tube protrudes from the recess and mates with a round, threaded aperture formed in an upwardly projecting portion of the lower receiver. The upwardly projecting portion is disposed in line with the barrel, above the main body of the lower receiver and the firing assembly components housed therein.

The AK pattern stock, on the other hand, defines a roughly rectangular block opposite the butt end and a recess along a top surface of the stock. A first end of the receiver defines a downwardly-angled face with a rectangular opening for receiving the block. A protrusion located above the rectangular opening protrudes toward the stock at a slight downward angle. When the block is inserted into the rectangular opening, the recess receives the protrusion. The protrusion includes an aperture through which a screw or pin may be extended, with an extending portion of the screw or pin being received by the recess to secure the stock to the receiver. Some variations of the AK pattern stock and receiver include a second protrusion below the rectangular opening at the stock first end and a corresponding second recess along the bottom surface of the stock.

Other differences exist between the AR-15 and AK pattern receivers. For example, unlike the AR-15 lower receiver, the AK-47 receiver defines an aperture for receiving the rifle barrel opposite the stock connection. Moreover, the AK pattern receiver houses all of the internal mechanisms, including the firing bolt, bolt carrier, piston, carrier spring, hammer assembly, trigger guard rivets, firing pin assembly, and disconnector assembly, in a single, relatively accessible space. This design allows for straightforward removal and replacement of the various components. The internal mechanisms of the AR-15, on the other hand, are split between the lower receiver, which couples to the stock, and an upper receiver, which receives the barrel. The internal space of the AR-15 lower receiver is somewhat tighter and more difficult to easily navigate than that of the AK pattern receiver.

Some attempts have been made to combine the favorable characteristics of various rifle types, including the AR-15 and AK pattern rifles, to create a firearm that enjoys multiple advantages over its various substituent firearms. For example, adapters have been created that interface with a receiver from a first firearm type and a stock from a second firearm type at an opposing surface. One example is an adapter configured to mate an AK pattern receiver with an AR-15 stock.

However, this approach suffers numerous shortcomings. For example, many such adapters are configured to replace the downwardly-angled first end of the AK pattern receiver to provide a vertical first end that facilitates receiving the AR-15 stock. This arrangement prevents the shooter from experiencing the recognizable feeling when absorbing and managing the recoil of an AK pattern rifle Further, such replacement adapters are relatively small, easily lost, may break or warp, and can be costly to replace. Importantly, the introduction of an adapter between the receiver and the stock may create inconsistencies if the fit between the three pieces is less than perfect, or if the adapter wears over time and use. Such inconsistencies can affect the accuracy, recoil action, and integrity of the firearm, leading to unreliable and dangerous performance.

SUMMARY OF THE INVENTION

In a preferred example of the invention, a hybrid firearm receiver includes a receiver body having a first end, a second end opposite the first end, a bottom surface extending from the first end to the second end and transitioning to two upwardly extending opposing sidewalls, and a top end. The receiver body extends along a longitudinal axis from the first end to the second end. The first end is integrally formed with the receiver body and defines a first outer face and a rail interface having a first maximum width and a first maximum height. The first maximum width is preferably less than the first maximum height. The rail interface typically includes a plurality of flats that extend along the maximum width and that have side edges that define the maximum width. The side edges of the rail interface are preferably spaced apart from the first outer face to facilitate receiving a clamping mount of a gunstock between the side edges of the rail interface and the first outer face. The plurality of flats preferably each have a flat rear face disposed along a first plane. The first plane is typically transverse and non-perpendicular to the axis.

The two opposing sidewalls project upwardly from the bottom surface along the length of the receiver body between the first end and the second end and preferably terminate at the top end to form a rim along the length of the receiver body between the first end and the second end. A segment of a one of the opposing sidewalls typically abuts the second end extending upwardly above a corresponding segment of the other opposing sidewall. A topmost edge of the rail interface is preferably lower than the top end. The top end typically joins the two opposing sidewalls adjacent the first end and toward the second end. The top end, the two opposing sidewalls, and the first end preferably form a trough extending transverse to the axis.

In some versions, the second end has a second outer face, and the axis is perpendicular to the second outer face.

Preferably, the bottom surface is substantially planar as it extends from the first end to the second end along a second plane such that the second plane is substantially perpendicular to the first plane and transverse to the axis.

In some versions, the second end defines a cavity below the aperture and open along the bottom surface such that the cavity defines a rounded rectangle.

Preferably, the rail interface is configured to receive at least a portion of a gunstock assembly, and the aperture is configured to receive at least a portion of an AK pattern rifle barrel, such as, for example, an AK-47 rifle barrel, an AK-74 rifle barrel, an AKM rifle barrel, or an AK-100 rifle barrel.

In some versions, the rail interface is configured to receive at least a portion of an AR-15 gunstock assembly, and the aperture is configured to receive at least a portion of an AK pattern rifle barrel.

Preferably, the first end has a flat top surface having a top length parallel to the axis, and the top length is from 0.25 inches to 0.5 inches.

In some versions, the receiver body is from 9 inches to 12 inches from the first end to the second end along the axis. Preferably, the second end has a second outer face, and the receiver body is from 10 inches to 11 inches from the first outer face to the second outer face along the axis. In some versions, the second end has a second outer face, and the receiver body is from 10.5 inches to 10.9 inches from the first outer face to the second outer face along the axis. Preferably, the second end has a second outer face, and the receiver body is 10.7 inches from the first outer face to the second outer face along the axis.

In some versions, the rail interface includes a bottom flat having a flat rear face, and the bottom surface smoothly transitions to the flat rear face of the bottom flat of the rail interface.

Preferably, the top end, the sidewalls, and the first end form a trough adjacent the first end and extending transverse to the axis.

In some versions, the rail interface includes a Picatinny rail.

In another example of the invention, a firearm includes a hybrid firearm receiver according to the invention, an AR-15 rifle stock, and an AK pattern rifle barrel.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 10:
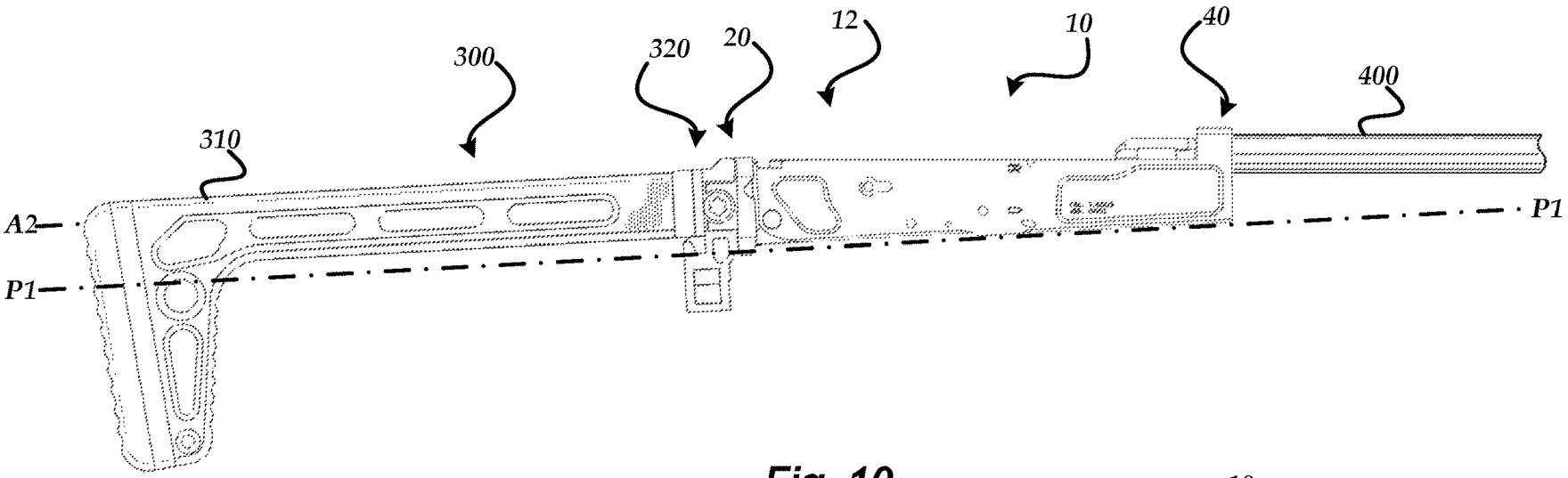
FIG. 10 is a right side elevational view of a hybrid firearm receiver according to the invention, coupled to the AR-15 rifle stock assembly of FIG. 9 and receiving an AK pattern rifle barrel.
Figure 11:
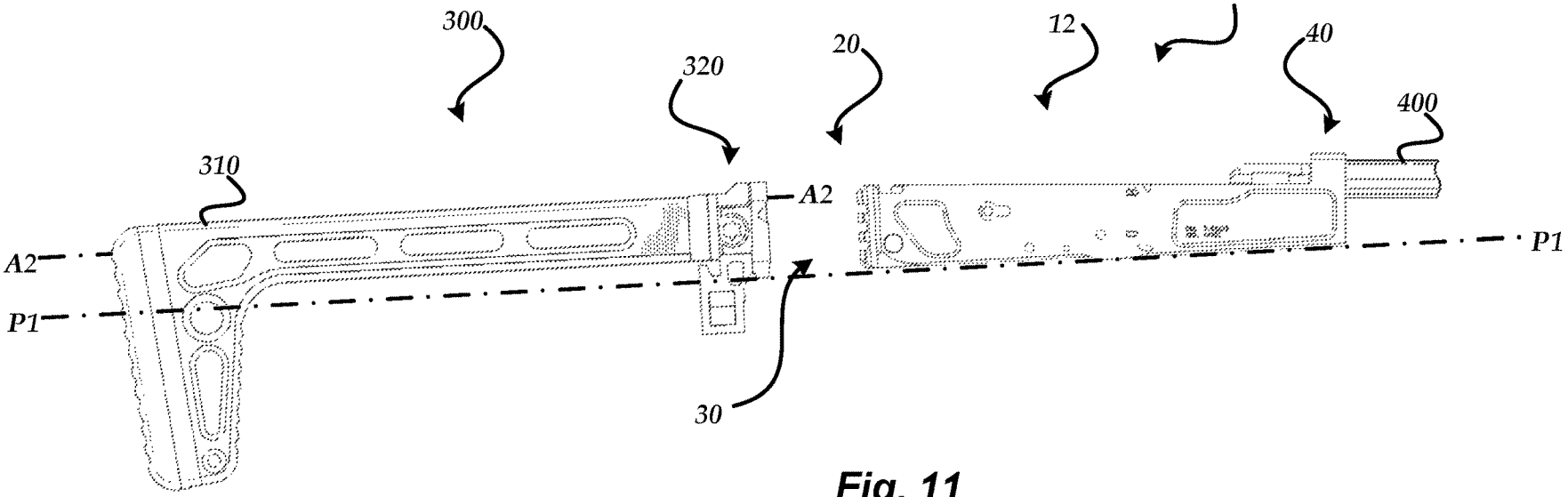
FIG. 11 is a right side elevational view of the hybrid firearm receiver of FIG. 1 decoupled from the AR-15 rifle stock assembly of FIG. 9 and with the components of the AR-15 rifle stock assembly exploded.

A hybrid firearm receiver is illustrated alone in FIGS. 1-8 and in combination with other firearm components in FIGS. 10 and 11.

Figure 1:
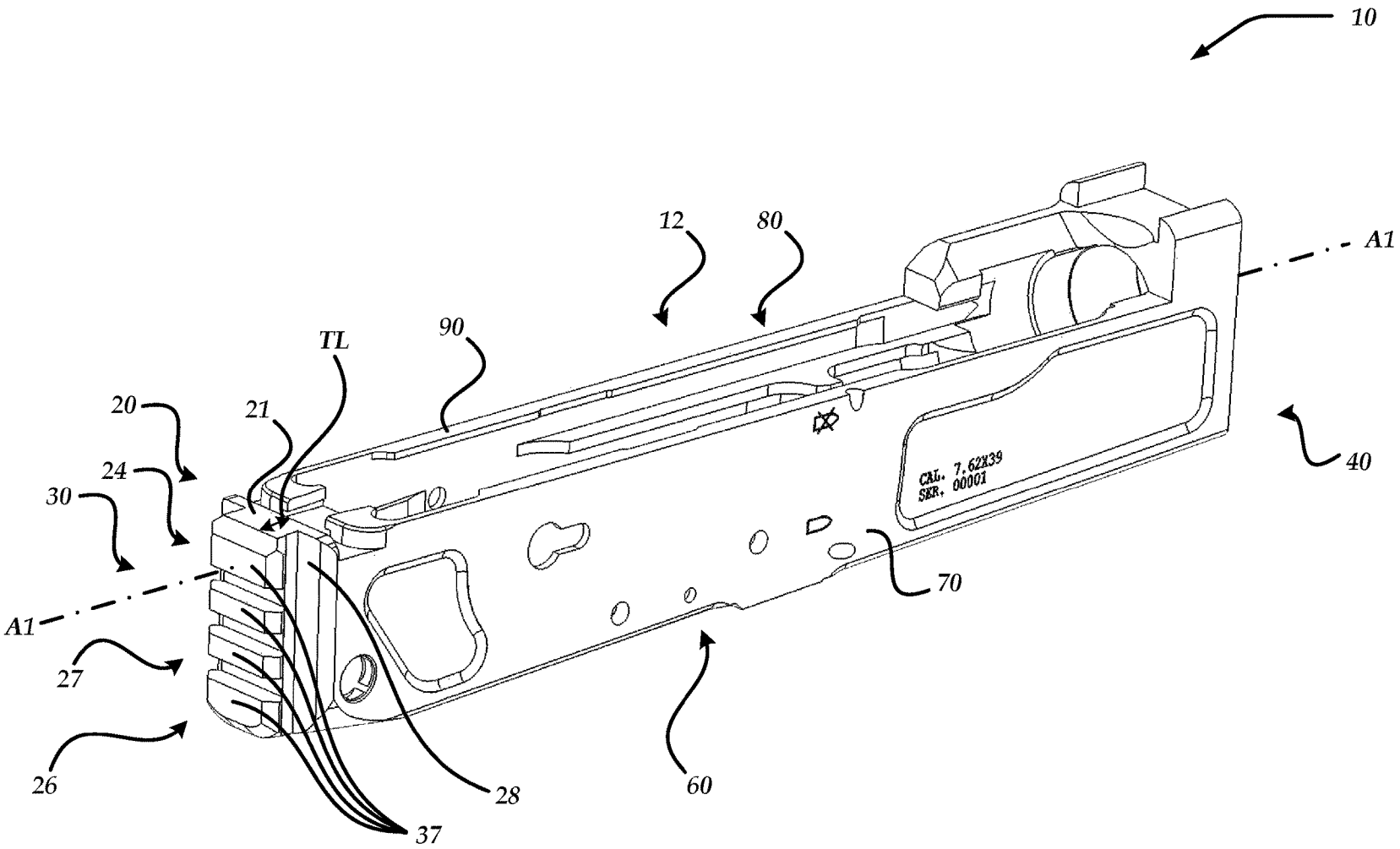
FIG. 1 is a top perspective view of a preferred example of a hybrid firearm receiver elongated along an axis A1.

As best seen in FIG. 1, the hybrid firearm receiver 10 includes a receiver body 12 having a first end 20, a second end 40 opposite the first end 20, and a bottom surface 60 extending from the first end 20 to the second end 40 and transitioning to two upwardly extending opposing sidewalls 70, 80. The two opposing sidewalls 70, 80 terminate at a top end 90 to form a rim along the length of the receiver body 12 from the first end 20 to the second end 40. The receiver body 12 extends along a longitudinal axis A1 from the first end 20 to the second end 40.

The first end 20 is integrally formed with the receiver body 12 and includes a rail interface 30. The rail interface 30 is preferably shaped and dimensioned to comply with a military standard for rail interface systems, preferably the Picatinny rail standards, such as MIL-STD-1913 or STANAG 2324. The rail interface 30 includes a rail system typically used for mounting accessories to the tops of receivers, such as scopes or other sights. As shown in FIG. 1, the rail interface 30 has a flat top surface 21, an upper interface flat 24, a lower interface flat 26, and a plurality of middle interface flats 27 between the upper interface flat 24 and the lower interface flat 26. The flats 24-27 preferably each have a "flatted T" or hexagonal cross-section that is offset and spaced apart from a rear surface 28 of the body 12 by a distance that equates or substantially equates (for example, within 5, 10, 15, or 20 percent) of a top length TL of the flat top surface 21 extending parallel to the axis A1 (preferably 6.32 mm). The flats 24-27 are vertically offset and spaced apart from each other by crosswise slots. The flats 24-27 provide a plurality of flat rear faces 37. The slots extend inward from the flat rear faces 37 along the axis A1.

Figure 2:
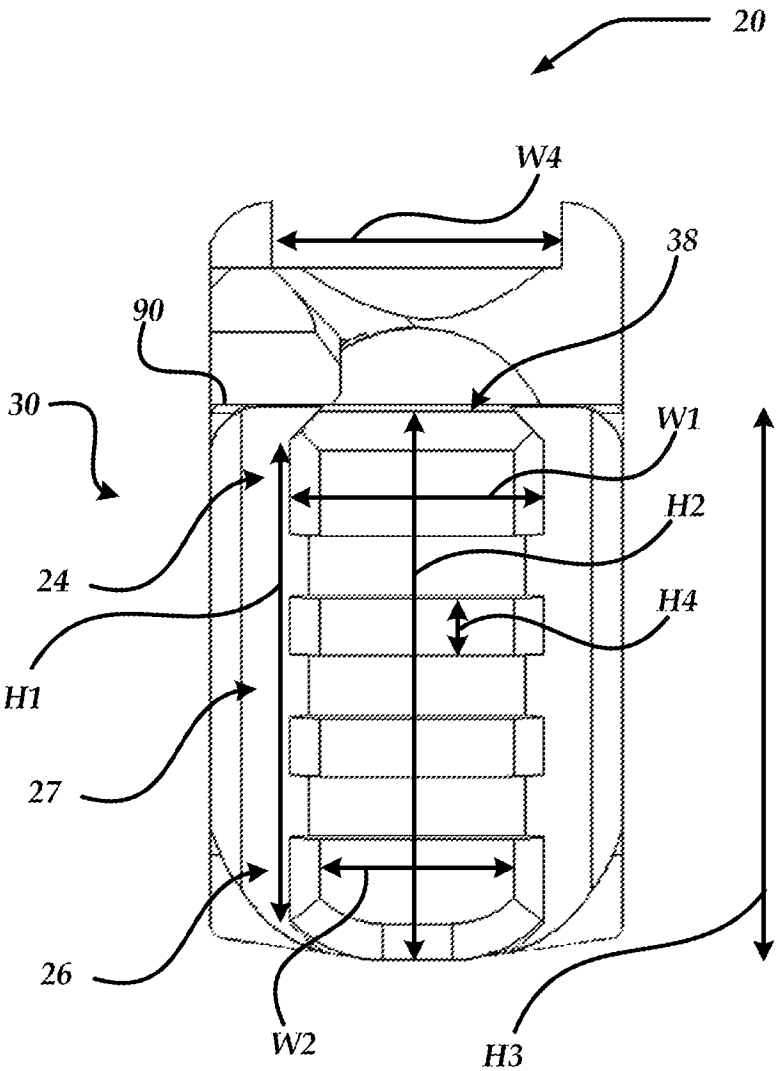
FIG. 2 is a front elevational view of a first end of the firearm receiver of FIG.

Preferably, the flats 24-27 (or at least the plurality of middle flats 27) each have a height of 4.75 mm (see H4 in FIG. 2), the slots have a height of 5.25 mm (parallel to H4), the flats 24-27 have a maximum or total width of 21.2 mm (see W1 in FIG. 2), the flats 24-27 have a length of 3 mm (perpendicular to H4 and W1), and the flat rear faces 37 each have a width of 15.67 mm (see W2 in FIG. 2). The rail interface 30 preferably has a usable height H1 (height of the portion of the rail interface 30 that provides gripable edges along its height) that is less than the height H3 of the rear surface 28 of the body 12 (see FIG. 2). The rail interface 30 preferably has a maximum or total height H2 that is less than the height of H3 of the rear surface 28. As shown in FIG. 2, the bottom edge of the rail interface 30 is preferably in the same plane as the bottom edge of the rear surface 28 of the body 12 and the bottom surface 60 at the first end 20. Accordingly, a topmost edge 38 of the rail interface 30 is preferably lower than the top end 90.

Figure 5:
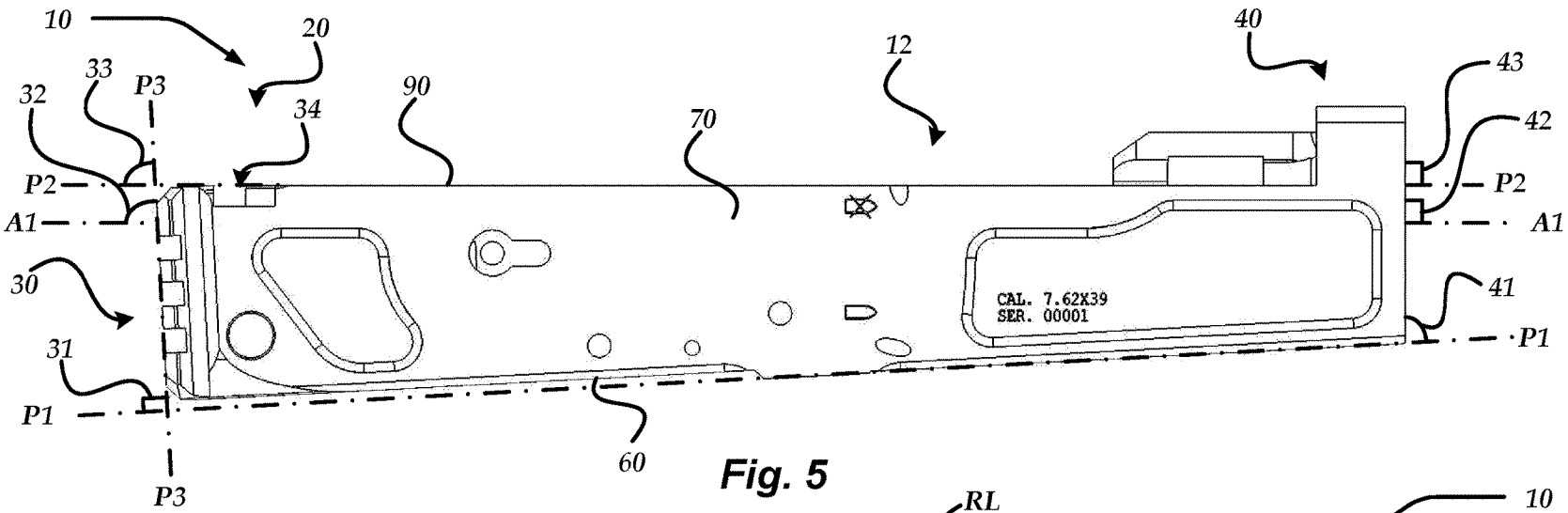
FIG. 5 is right side elevational view of the hybrid firearm receiver of FIG. 1, the receiver elongated along the axis A1 and the bottom surface inclined substantially along a plane P.
Figure 6:
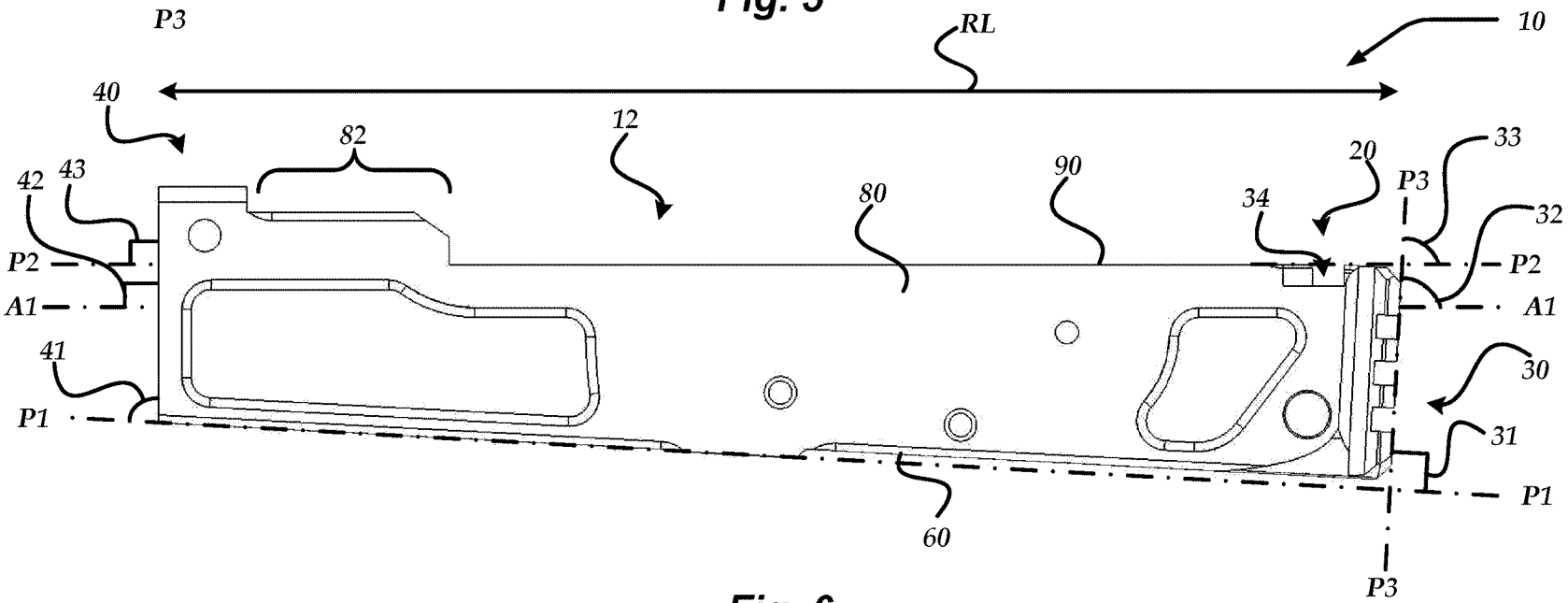
FIG. 6 is a left side elevational view of the hybrid firearm receiver of FIG. 1.
Figure 7:
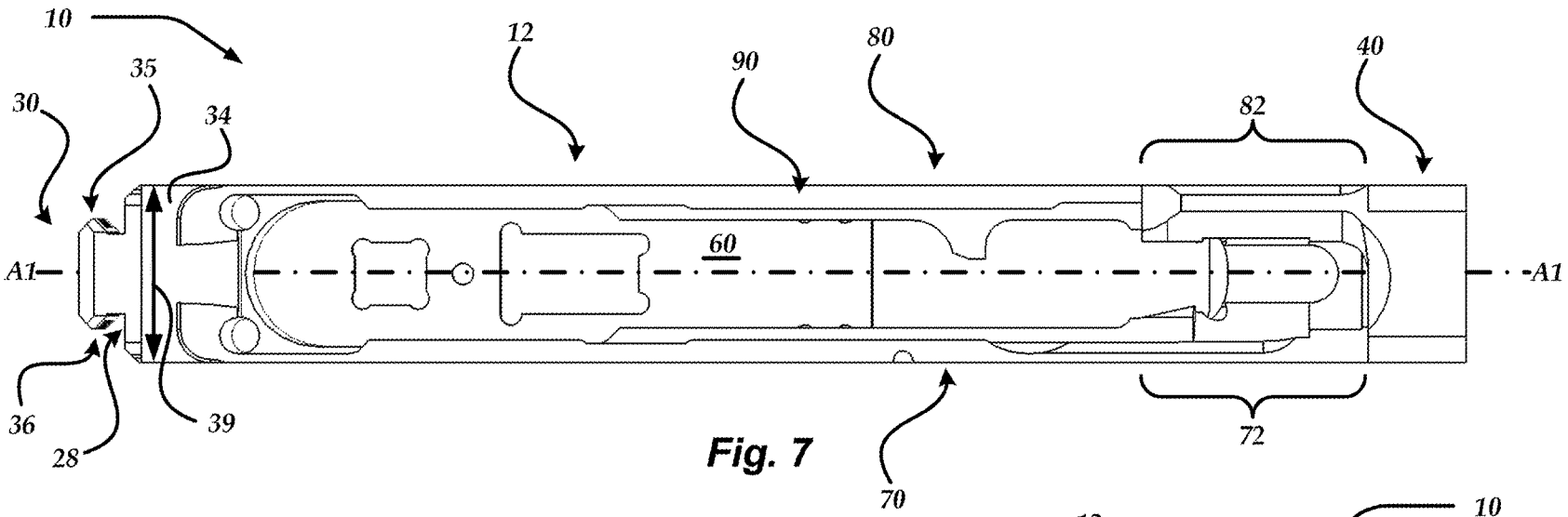
FIG. 7 is a top plan view of the hybrid firearm receiver of FIG. 1.

As best seen in FIGS. 5-7, the top end 90, the sidewalls 70, 80 (80 not shown in FIG. 5; 80 not shown in FIG. 6), and the first end 20 form a trough 34 adjacent the first end 20 and extending transverse to the axis A1 (for example, the trough 34 has a major dimension 39 that extends transverse to the axis A1). The top end 90 extends parallel to the axis A1 along the length of the receiver body 12 between the first 20 and second 40 ends along a plane P2.

Figure 3:
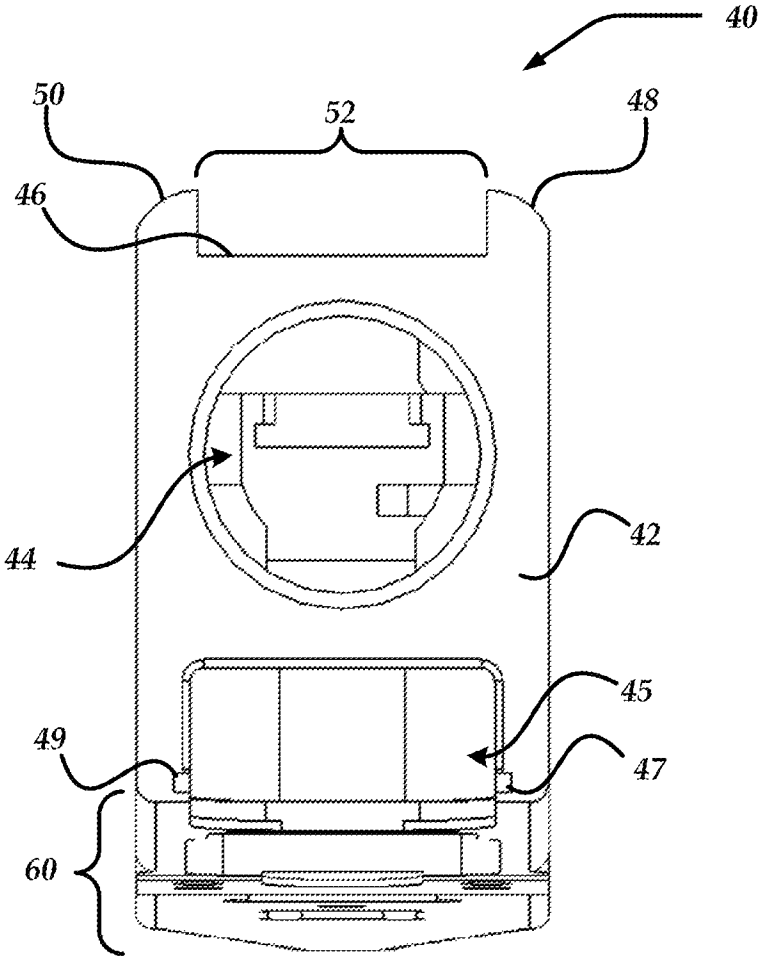
FIG. 3 is a front elevational view of a second end, opposite the first end, of the hybrid firearm receiver of FIG. 1.
Figure 4:
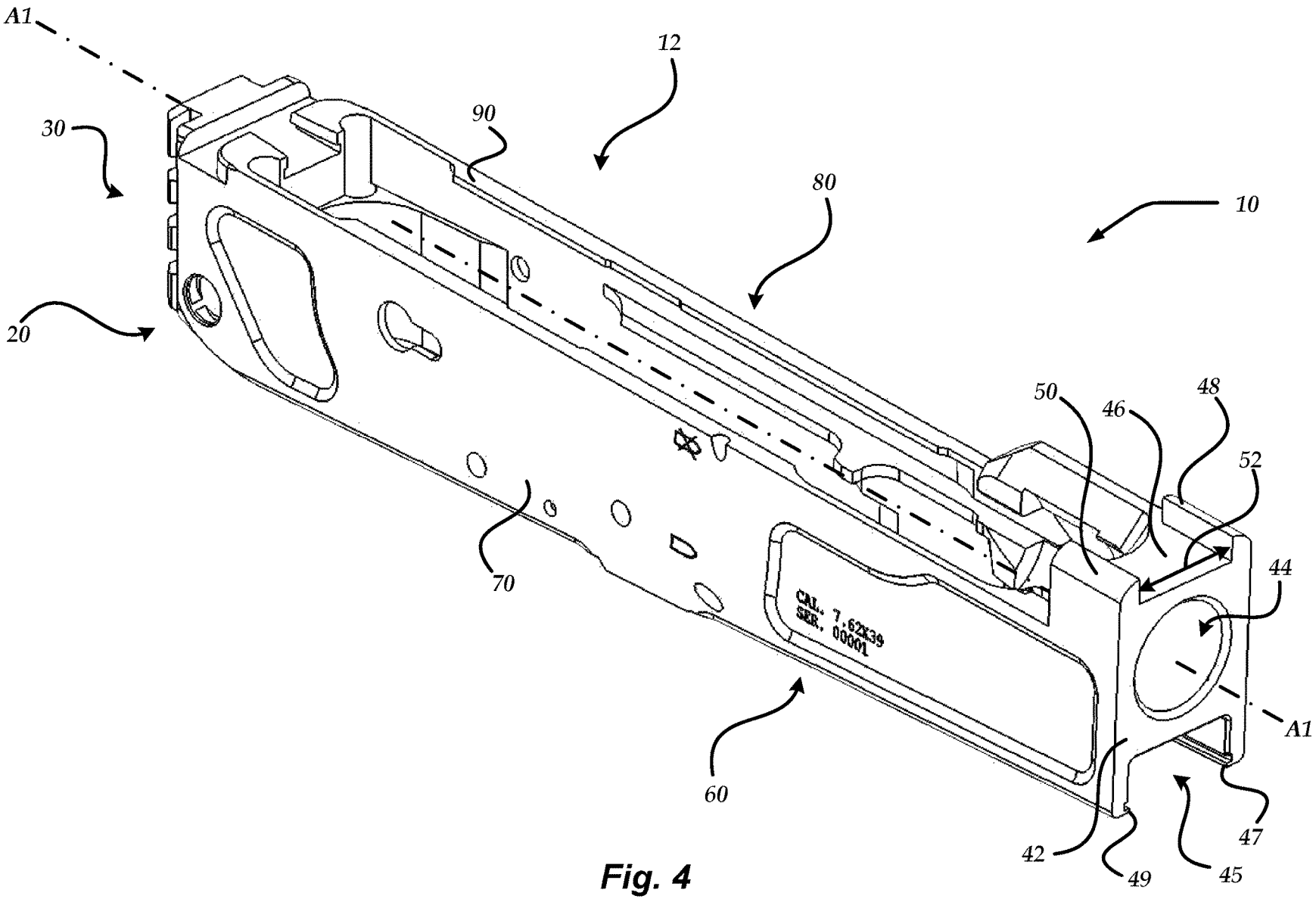
FIG. 4 is a second top perspective view of the hybrid firearm receiver of FIG.

Turning to FIGS. 3 and 4, the second end 40 defines a second outer face 42 with an aperture 44, the axis A1 extending through the aperture 44. The second outer face 42 has a width, transverse to the axis A1, of 1.35 inches. The second end 40 includes a top surface 46 with two opposing upwardly extending projections 48, 50 and a channel 52 therebetween, the channel 52 bounded by the projections 48, 50 and open in both directions parallel to the axis A1. The second outer face 42 further defines a third cavity 45 in the shape of a rounded rectangle below the aperture 44 and open along the bottom surface 60 (see FIG. 8). Preferably the bottom of the aperture 44 is defined along the bottom surface 60 by two rails 47, 49. The bottom surface 60 transitions upwardly along a curve transverse to the axis A1 to form the two opposing sidewalls 70, 80. Alternatively, the transition may be sharp, forming an angle between the bottom surface 60 and each of the two opposing sidewalls 70, 80. Each of the two opposing sidewalls 70, 80 extends upwardly and, in at least the preferred embodiment, perpendicular to the bottom surface 60.

As seen in FIG. 5, the bottom surface 60 is substantially planar and extends transverse to the axis A1 along the length of the receiver body 12 between the first 20 and second 40 ends. By "substantially planar", it is meant that a plane P1 extends along the bottom surface 60 from the first end 20 to the second end 40 and that no portion of the bottom surface 60 extends below the plane P1 by a distance greater than ten percent of the height of an adjoining sidewall 70, 80 when a portion of the bottom surface 60 is in contact with the plane P1. For example, if the sidewall 70 has a height of 1.5 inches at a given point and a portion of the bottom surface 60 is in contact with the plane P1, the bottom surface at that point extends no more than 0.15 inches below the plane P1. In the preferred embodiment, the bottom surface 60 extends no more than 0.06 inches below the plane P1. In the preferred embodiment, the plane P1 is transverse to the axis A1 along a 2.5 degree incline. However, in other embodiments, the plane P1 may be transverse to the axis A1 along an incline of from 1 degree to 3.5 degrees (for example, 3.1 degrees).

The flat rear faces 37 extend along a plane P3. The plane P3 is preferably perpendicular or substantially perpendicular (for example, within 1, 1.5, 2, 2.5, or 3 degrees of perpendicular) to the plane P1 (see angle 31 in FIGS. 5 and 6). The plane P3 is preferably transverse (or non-parallel) yet non-perpendicular to the axis A1 and the plane P2. An angle 32 between the plane P3 and an angle 33 between the plane P3 and the plane P2 are preferably equal and equate or substantially equate (for example, within 1, 1.5, 2, 2.5, or 3 degrees) of 87.5 degrees. The second outer face 42 is preferably angled relative to the plane P3 (see angle 41 in FIGS. 5 and 6) by an amount that matches or substantially matches (for example, within 1, 1.5, 2, 2.5, or 3 degrees) one or both of the angles 32, 33.

As seen in FIG. 6, the receiver body 12 has a length RL, which in the preferred embodiment may be 10.7 inches from the first end 20 to the second end 40 along the axis A1. A segment 82 of one of the opposing sidewalls 70, 80 abuts the second end 40 and extends upwardly above a corresponding segment 72 of the other opposing sidewall 70 (see FIG. 7). To form the upper interface flat 24 and the lower interface flat 26, the bottom surface 60 and a portion of each of the sidewalls 70, 80 change conformation along the first end 20. For example, the bottom surface 60 has a bottom width W3 along the first end 20 that narrows and subsequently widens and then narrows again as it approaches the plurality of flat rear faces 37 (see FIG. 8). Additionally, the transition from the bottom surface 60 to the sidewalls 70, 80 becomes more gradual approaching the plurality of flat rear faces 37 (see FIG. 6). For example, a string held against the flat rear face of the bottom flat 26 and against the bottom surface 60 without any pressing forces therebetween would contact the receiver body 12 along an entirety of the length of the string between the two holding points, demonstrating that the bottom surface 60 smoothly transitions to the flat rear face of the bottom flat 26 of the rail interface 30. A lower portion of each of the sidewalls 70, 80 transitions from following a direction parallel to the axis A1 to following a direction transverse to the axis A1.

Figure 8:
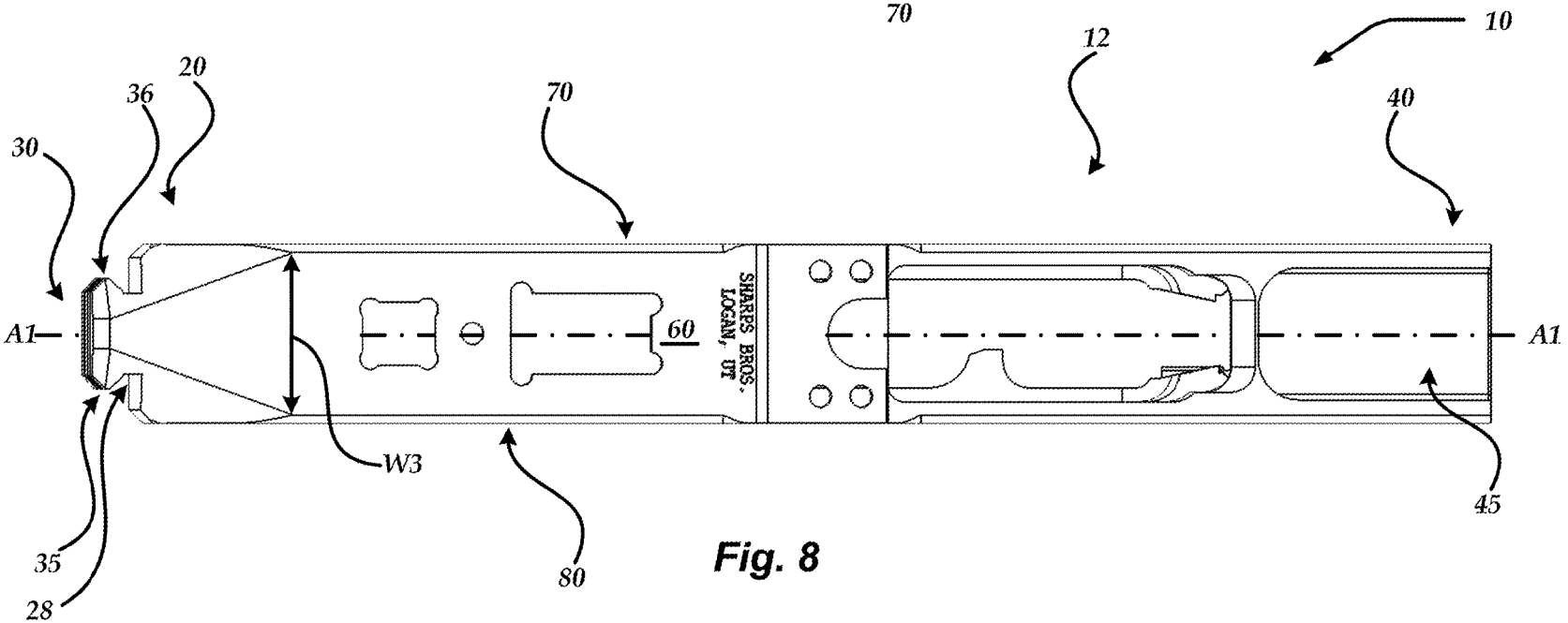
FIG. 8 is a bottom plan view of the hybrid firearm receiver of FIG. 1.
Figure 9:
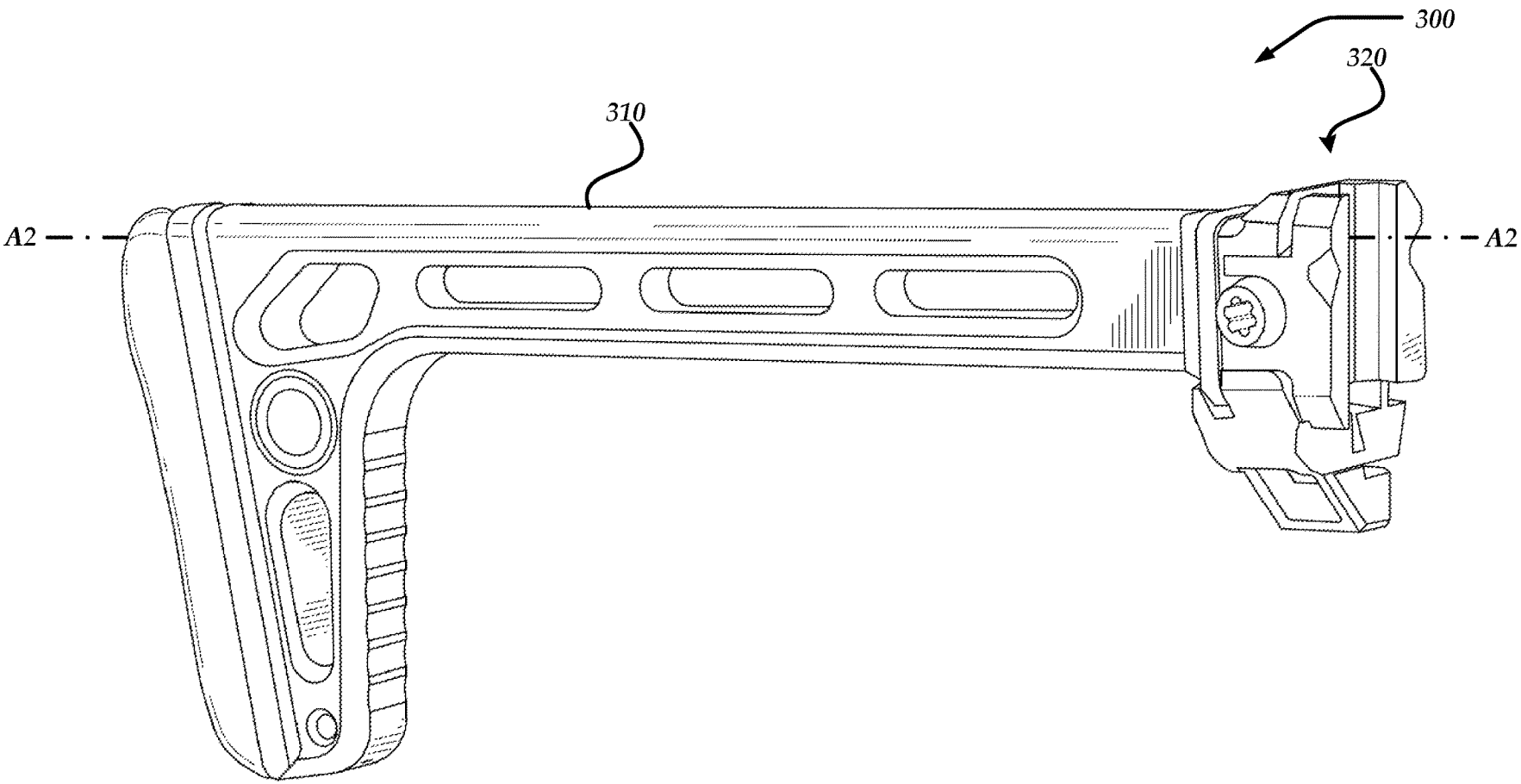
FIG. 9 is a right side elevational view of an AR-15 rifle stock assembly configured to couple to the hybrid firearm receiver of FIG. 1.

As shown in FIGS. 7 and 8, the rail interface 30 preferably has a left-most edge 35 and a right-most edge 36 that are spaced apart from the rear surface 28 to facilitate receiving a clamping rail mount of a gunstock in the space between the left-most and right-most edges 35, 36 and the rear surface 28. For example, gunstock assembly may include a gunstock 310 extending along a longitudinal axis A2 and having a clamping rail mount 320 disposed on the receiver end portion of the gunstock 310. In some cases, the gunstock 310 may be an AR-15 or AK pattern gunstock without a buffer tube extension. The rail mount 320 is preferably shaped and dimensioned to comply with the same military standard as the rail interface 30.

Turning to FIGS. 10 and 11, the hybrid firearm receiver 10 has the first end 20 coupled with the rifle stock assembly 300 and the second end 40 coupled (having received and secured) an AK pattern rifle barrel 400. In FIG. 10, the firearm receiver 10, rifle stock assembly 300, and AK pattern rifle barrel 400 are shown assembled together, while in FIG. 11, the rifle stock assembly 300 is decoupled from the firearm receiver 10 to emphasize the relative orientation of the firearm receiver 10 and the rifle stock assembly 300. When mounted (see FIG. 10), the longitudinal axis A2 of the gunstock is preferably parallel or substantially parallel (for example, within 1, 1.5, 2, 2.5, or 3 degrees of parallel) to the plane P1.

The hybrid firearm receiver 10 permits use of an AR-15 rifle stock (without a buffer tube extension) and AK pattern rifle barrel in a single firearm. The AR-15 stock, among other advantages, decreases weight and enables greater customization of the firearm relative to an AK pattern rifle. The receiver 10 additionally provides easy access to the internal mechanisms, such as the firing mechanism, of the firearm. The receiver 10 is integrally formed, resulting in a single-piece construction that limits the potential for troublesome and dangerous inconsistencies associated with adapters. While component materials such as steel may be used to form the receiver 10, single-piece construction using, for example, a CNC machine may permit use of alternative materials, including, for example, billet 6061 or 7075 aluminum.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A firearm receiver, comprising:

a receiver body having a first end, a second end opposite the first end, a bottom surface extending from the first end to the second end and transitioning to two upwardly extending opposing sidewalls, and a top end, the receiver body extending along a longitudinal axis from the first end to the second end, the receiver body having a length extending along the longitudinal axis from the first end to the second end, the first end being integrally formed with the receiver body and defining a first outer face and a rail interface having a first maximum width and a first maximum height, the first maximum width being less than the first maximum height, the rail interface comprising a plurality of flats that extend along the maximum width and that have side edges that define the maximum width, the side edges of the rail interface being spaced apart from the first outer face to facilitate receiving a clamping mount of a gunstock between the side edges of the rail interface and the first outer face, the plurality of flats each having a flat rear face disposed along a first plane, the first plane being transverse and non-perpendicular to the axis, and the two opposing sidewalls projecting upwardly from the bottom surface along the length of the receiver body between the first end and the second end and terminating at the top end to form a rim along the length of the receiver body between the first end and the second end, a segment of a one of the opposing sidewalls abutting the second end extending upwardly above a corresponding segment of the other opposing sidewall, wherein a topmost edge of the rail interface is lower than the top end and wherein the top end joins the two opposing sidewalls adjacent the first end and toward the second end, the top end, the two opposing sidewalls, and the first end forming a trough, the trough having a major dimension extending transverse to the axis.

2. The firearm receiver of claim 1, wherein the second end has a second outer face, and the axis is perpendicular to the second outer face.

3. The firearm receiver of claim 1, wherein the bottom surface is substantially planar as it the bottom surface extends from the first end to the second end along a second plane, the second plane being substantially perpendicular to the first plane and transverse to the axis.

4. The firearm receiver of claim 1, wherein the second end defines an aperture and a cavity below the aperture and open along the bottom surface, the cavity defining a rounded rectangle.

5. The firearm receiver of claim 4, wherein the rail interface is configured to receive at least a portion of a gunstock assembly, and the aperture is configured to receive at least a portion of an AK pattern rifle barrel.

6. The firearm receiver of claim 4, wherein the rail interface is configured to receive at least a portion of an AR-15 gunstock assembly, and the aperture is configured to receive at least a portion of an AK pattern rifle barrel.

7. The firearm receiver of claim 1, wherein the first end has a flat top surface having a top length parallel to the axis, the top length being from 0.25 inches to 0.5 inches.

8. The firearm receiver of claim 1, wherein the receiver body is from 9 inches to 12 inches from the first end to the second end along the axis.

9. The firearm receiver of claim 8, wherein the second end has a second outer face, and the receiver body is from 10 inches to 11 inches from the first outer face to the second outer face along the axis.

10. The firearm receiver of claim 8, wherein the second end has a second outer face, and the receiver body is from 10.5 inches to 10.9 inches from the first outer face to the second outer face along the axis.

11. The firearm receiver of claim 8, wherein the second end has a second outer face, and the receiver body is 10.7 inches from the first outer face to the second outer face along the axis.

12. The firearm receiver of claim 1, wherein the rail interface includes a bottom flat having a flat rear face, and the bottom surface smoothly transitions to the flat rear face of the bottom flat of the rail interface.

13. The firearm receiver of claim 1, wherein the rail interface includes a Picatinny rail.

14. A firearm receiver, comprising:

the firearm receiver of claim 1;

an AR-15 rifle stock; and an AK pattern rifle barrel.

* * * * *